US005540646A

United States Patent [19]

Williams et al.

[11] Patent Number: 5,540,646

[45] Date of Patent: Jul. 30, 1996

[54] METHOD OF MAKING A SHRINKABLE BAG WITH PROTECTIVE PATCH

[75] Inventors: Gregory K. Williams; Sean A. Brady, both of Greer, S.C.

[73] Assignee: W. R. Grace & Co.-Conn., Duncan, S.C.

[21] Appl. No.: 407,793

[22] Filed: Mar. 20, 1995

Related U.S. Application Data

[62] Division of Ser. No. 50,942, Apr. 21, 1993, abandoned.

[51] Int. Cl.[6] ..... B31B 1/90

[52] U.S. Cl. ..... 493/210; 493/211

[58] Field of Search ..... 493/210, 211, 493/218, 219, 297; 156/200, 464

[56] References Cited

U.S. PATENT DOCUMENTS

| | | | |
|---|---|---|---|
| 2,870,954 | 1/1959 | Kulesza | 493/210 |
| 2,891,870 | 6/1959 | Selby et al. | 99/174 |
| 2,911,305 | 11/1959 | Ramsey, Jr. | 99/171 |
| 3,741,253 | 6/1973 | Brax et al. | 138/137 |
| 4,267,960 | 5/1981 | Lind et al. | 229/55 |
| 4,399,180 | 8/1983 | Briggs et al. | 428/212 |
| 4,425,268 | 1/1984 | Cooper | 524/110 |
| 4,456,646 | 6/1984 | Nishimoto et al. | 428/216 |
| 4,457,960 | 7/1984 | Newsome | 428/518 |
| 4,534,984 | 8/1985 | Kuehne | 426/412 |
| 4,539,236 | 9/1985 | Vilutis | 428/35 |
| 4,755,403 | 7/1988 | Ferguson | 428/35 |
| 4,765,857 | 8/1988 | Ferguson | 156/229 |
| 4,770,731 | 9/1988 | Ferguson | 156/229 |
| 4,975,688 | 12/1990 | Gonzales | 340/693 |
| 5,020,922 | 6/1991 | Schirmer | 383/119 |
| 5,057,065 | 10/1991 | Buchman | 493/211 |
| 5,234,731 | 8/1993 | Ferguson | 428/34 |

FOREIGN PATENT DOCUMENTS

| | | | |
|---|---|---|---|
| 11228/88 | 8/1988 | Australia . | |
| 2101427 | 5/1987 | Japan | 493/210 |

*Primary Examiner*—Jack W. Lavinder
*Attorney, Agent, or Firm*—John J. Wasatonic; William D. Lee, Jr.; Rupert B. Hurley, Jr.

[57] ABSTRACT

Disclosed is an oriented, heat shrinkable, thermoplastic vacuum bag having a protective heat shrinkable patch attached thereto such that said heat shrinkable patch covers substantially all area exposed to bone, thereby protecting the bag from puncture by sharp protruding bones in bone-in cuts of meat which are vacuum packaged within the bags. The protection is especially directed to prevention of bag puncture by, bone-in cuts of both fresh and smoked or processed meat. The bag produced by this method is also disclosed.

34 Claims, 6 Drawing Sheets

METHOD OF MAKING A SHRINKABLE BAG WITH PROTECTIVE PATCH

This is a divisional application of application Ser. No. 08/050,942, filed Apr. 21, 1993 now abandoned.

BACKGROUND OF THE INVENTION

1. Field of the Invention

This invention relates to the packaging of bone-in cuts of meat as well as processed meats. In particular, this invention relates to a heat shrinkable bag with a heat shrinkable protective patch which prevents or reduces the likelihood that a bone will completely puncture and rupture a thermoplastic vacuum bag and patch combination.

2. Description of the Related Art

The use of heat shrinkable thermoplastic as flexible packaging materials for vacuum packaging various foodstuffs including meat is well-known. Such plastic materials, however, while in general quite successful for packaging meat understandably have difficulties in successfully packaging sharp or bony products. For example, attempts to package bone-in primal cuts of meat usually result in an unsatisfactorily large number of bag failures due to bone punctures. The use of cushioning materials such as paper, paper laminates, wax impregnated cloth, and various types of plastic inserts have proved to be less than totally satisfactory in solving the problem. The preparation of special cuts of meat or close bone trim with removal of offending bones has also been attempted. However, this is at best only a limited solution to the problem since it does not offer the positive protection necessary for a wide variety of commercial bone-in types of meat. Furthermore, removal of the bone is a relatively expensive and time consuming procedure.

An example of the prior art method of protecting a thermoplastic bag from puncture is shown in U.S. Pat. No. 2,891,870 issued on Jun. 23, 1959 to Meyer S. Selby et al. In the Selby patent the exposed bone in a bone-in cut of meat is covered with a wax Impregnated cloth and the thus protected meat is placed in a heat shrinkable plastic bag. Another example of the prior art methods of protecting a thermoplastic bag from puncture is shown in U.S. Pat. No. 4,755,403 issued on Jul. 11, 1988 to Daniel J. Ferguson. The Ferguson patent teaches a method of providing an external multi-layer protective patch for a heat shrinkable thermoplastic bag, said patch being located on what becomes the side of the bag after the product is loaded into the bag. While this patent provides bone caused rupture protection along a small area of the side of the bag such as for example, turkey leg bone punctures, it does nothing to protect a bag containing a end-bone piece of meat such as a ham shank. Another side wall patch teaching may be found in Australian published patent application abstract AU-A-11228/88 published Aug. 4, 1988.

OBJECTS AND SUMMARY OF THE INVENTION

It is one object of the present invention to provide a heat shrinkable bag having a heat shrinkable patch material located such that it will minimize and eliminate the puncturing of flexible, heat shrinkable vacuum bags by sharp bones.

Another object of the present invention is to provide a heat shrinkable patch for a thermoplastic vacuum bag which is relatively strong and tough and which can be readily adhered to either the outer surface or the inner surface of a thermoplastic vacuum bag.

A further object of the present invention is to provide a heat shrinkable patch for a thermoplastic vacuum bag which is located such that it protects large areas of the thermoplastic vacuum bag from puncture by end-bone meat cuts.

Accordingly, one form of the present invention relates to a method of making a heat shrinkable bag having a protective heat shrinkable patch attached thereto comprising: (a) producing an oriented, heat shrinkable, thermoplastic tubing in a lay fiat configuration; (b) applying at least one heat shrinkable patch to one surface of the tubing using an adhesive sealing means; (c) and forming a bag from the heat shrinkable patch adhering thermoplastic tubing; thereby producing an oriented, heat shrinkable, thermoplastic bag having a heat shrinkable patch attached in a desired position thereon.

Another form of the present invention relates to a method of making a heat shrinkable bag having a protective heat shrinkable patch attached thereto comprising: (a) producing an oriented, heat shrinkable, thermoplastic tubing in a lay fiat configuration; (b) applying at least one heat shrinkable patch to one surface of the tubing using an adhesive sealing means; (c) inflating and rotating the heat shrinkable patch adhering tubing of step (b) a desired number of degrees; (d) flattening said inflated and rotated tubing of step (c) back to a lay fiat configuration with the heat shrinkable patch relocated in a desired position on the tubing; (e) and forming a bag from the heat shrinkable patch adhering thermoplastic tubing; thereby producing an oriented, heat shrinkable, thermoplastic bag having a heat shrinkable patch attached in a desired position thereon.

Preferred forms of the invention, as well as other embodiments, objects, features and advantages of this invention, will be apparent from the following detailed description which is to be read in connection with the accompanying drawings.

BRIEF DESCRIPTION OF THE DRAWINGS

In the drawings which are appended hereto and make a part of this disclosure.

DESCRIPTION OF THE PREFERRED EMBODIMENTS OF THE INVENTION

Figure 1:
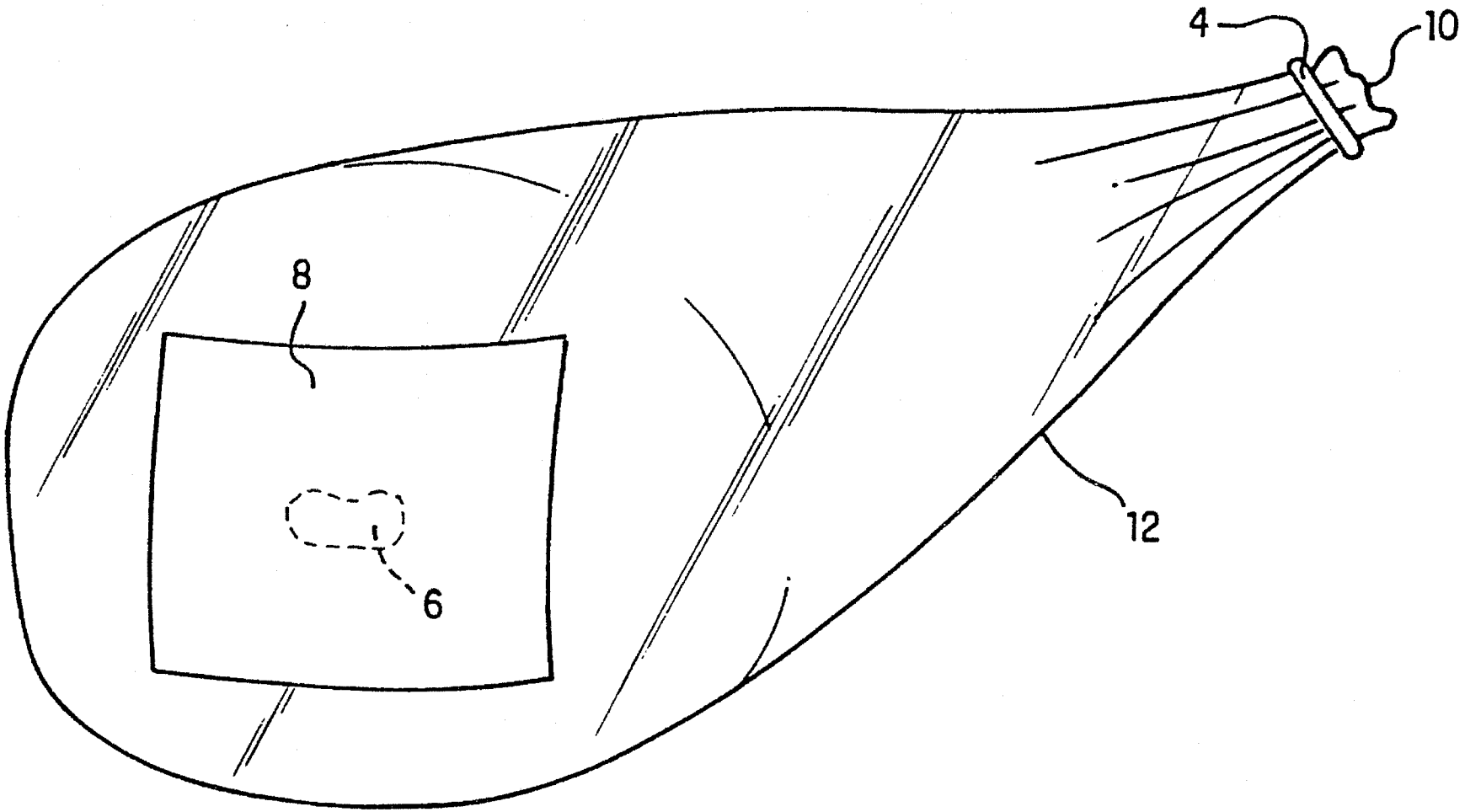
FIG. 1 is a perspective view of meat enclosed in a heat shrunk bag with the heat shrunk patch of the present invention on the exterior end thereof.

Many cuts of meat have bones that are on the side of the product and/or at the ends of the product. Examples of side bone products include, for example, short loin, spareribs, short ribs and picnics. Picnics and hams are examples of end bone products. Presently referred bone-in product suitable for packaging in the present invention include, for example, bone-in spareribs, picnics, back ribs, short loins, short ribs, smoked and/or preserved meats such as whole turkeys and picnics. The present invention provides better protection against bag rupture for both types of bone-in meat products. In addition the present invention substantially eliminates the extra time and the difficulties of inserting separate bone guard materials such as waxed cloth. Also, separate bone guard material insertion forced the rotation of the resulting bag 90°, in many instances, to correctly position the product, thus preventing use of taped bag loaders. The present invention allows the advantageous use of taped bag loaders because of the ease of placement of the heat shrinkable patch in relationship to the product to be packaged.

The present invention will be better understood from the specification taken in conjunction with the accompanying drawings in which like reference numerals refer to like parts.

Referring now to FIG. 1–7, there is provided a bone-in cut of meat 2 (FIG. 2), for example, a picnic, having exposed bone portion 6. There is also provided patch 8 on bag 12 covering a substantial portion of the visible originally closed end of the bag. Having a patch on the outside of the bag facilitates the step of loading the bag by eliminating the concern over dislodging a manually laid on cloth patch or a patch adhered to the inside of the bag. Loading can, therefore, take place more readily and easily. After a bone-in cut is loaded into the bag, air is evacuated from the package and the bag neck 10 is gathered having the appearance as shown in FIG. 1 and thereafter is either clipped closed using a clip 4 or is heat sealed using a heat sealing means (not shown) to securely seal the bag. The bag can then be immersed in hot water and shrunken tightly against the meat thus providing a meat product in an evacuated atmosphere for aging and preservation. The heat shrinkable patch 8 shrinks with the bag thus reducing the tendency to delaminate as when the patch is not shrinkable in the same manner as the bag.

Figure 2:
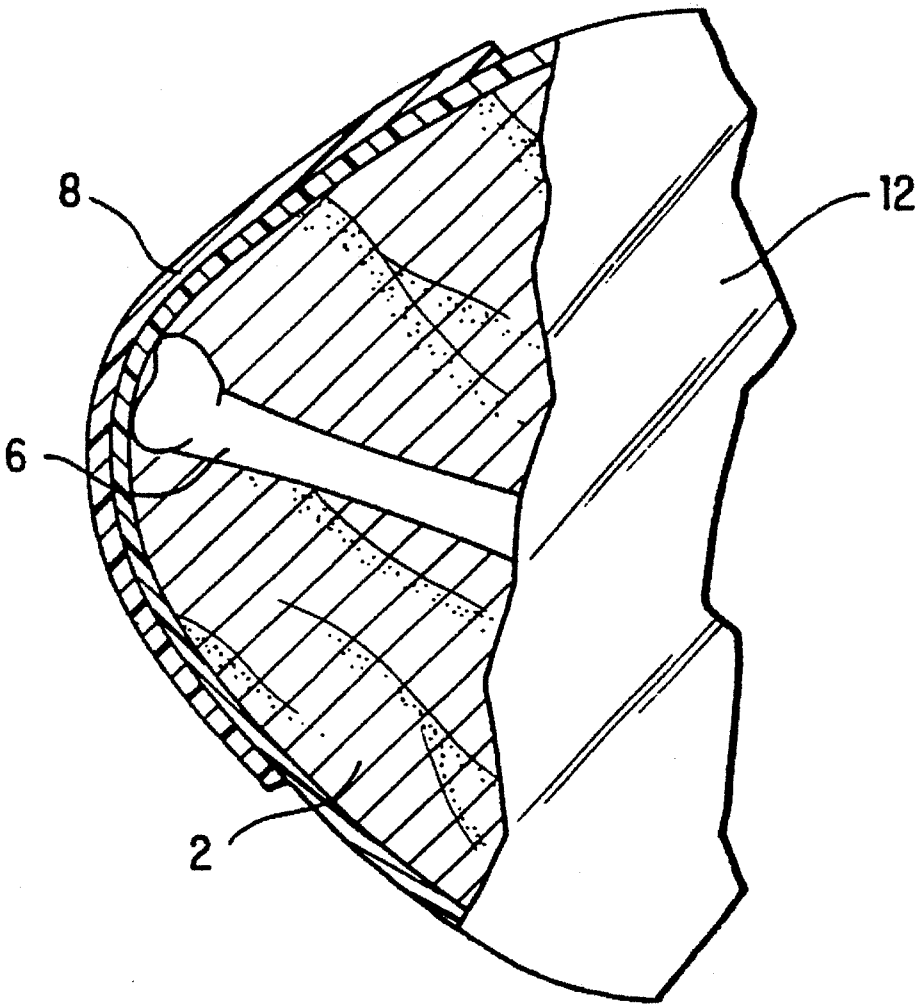
FIG. 2 is a sectional view showing the heat shrunk bag with the heat shrunk patch of the present invention and a bone-in meat product therein.

FIG. 2 shows the exposed bone portion 6 covered by bag 12 with the preferred heat shrinkable patch 8 adhered to the outside of the bag over the bone protrusion.

Figure 3:
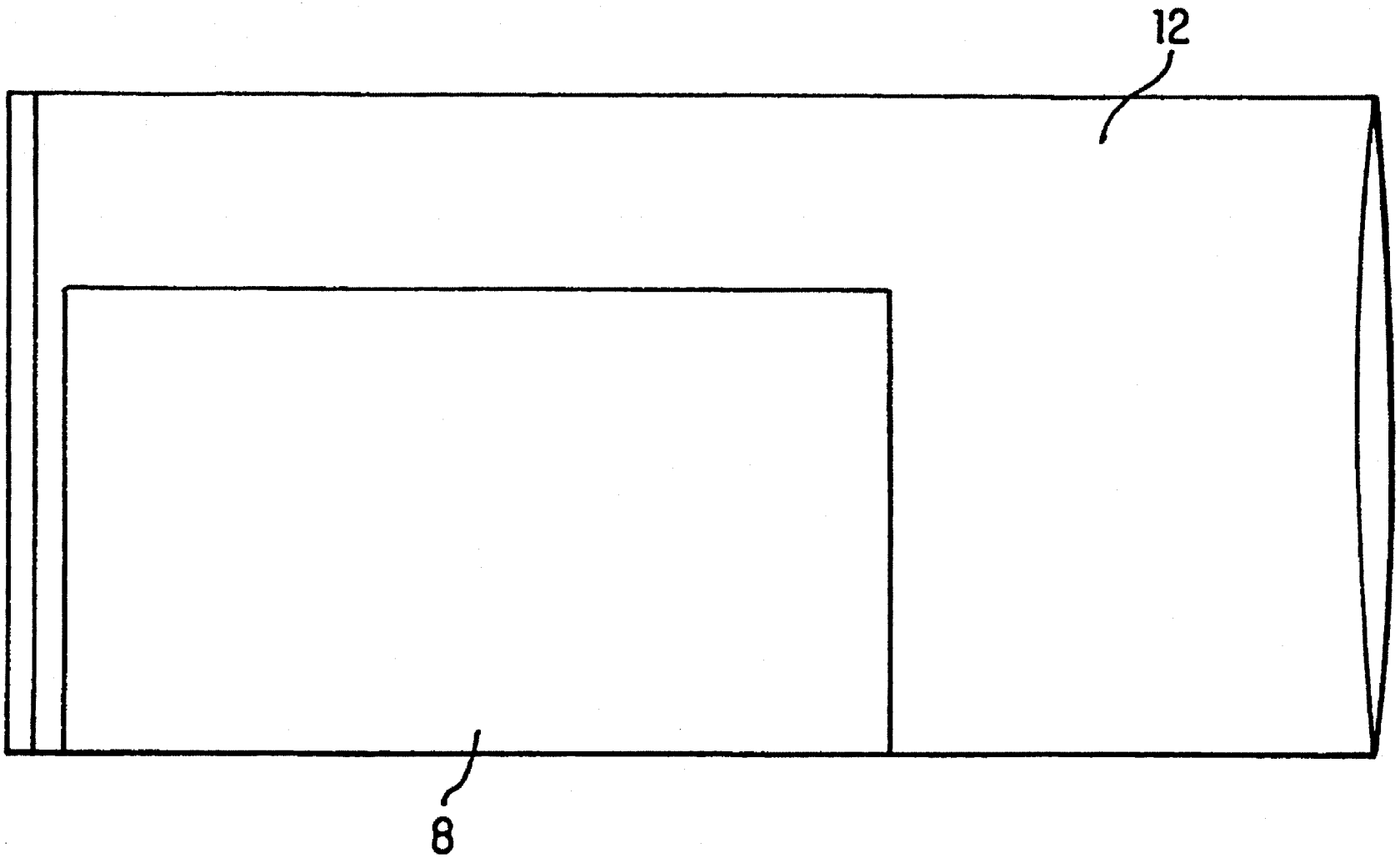
FIG. 3 is a plan view showing another embodiment of the heat shrinkable patch of the present invention adhered to the side area of a thermoplastic vacuum bag.

FIG. 3 shows one half of a heat shrinkable patch 8 adhered to the side portion of bag 12 in a lay flat position. This heat shrinkable patch 8 may fold around the edge of the bag in this lay flat position or 2 separate patches, one on each side of the fold line may be advantageously employed.

Figure 4:
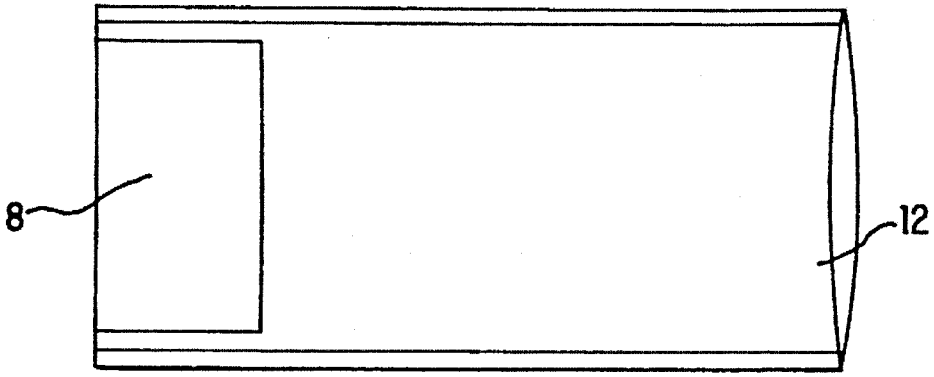
FIG. 4 is a plan view showing one embodiment of the heat shrinkable patch of the present invention adhered to the end area of a thermoplastic vacuum bag.

In FIG. 4 one half of heat shrinkable patch 8 is shown adhered to the closed end portion of one side of a bag 12 in a lay fiat position. Preferably heat shrinkable patch 8 will cover substantially the whole bag bottom area on both sides of the bag when the bag is filled with meat product.

Figure 5:
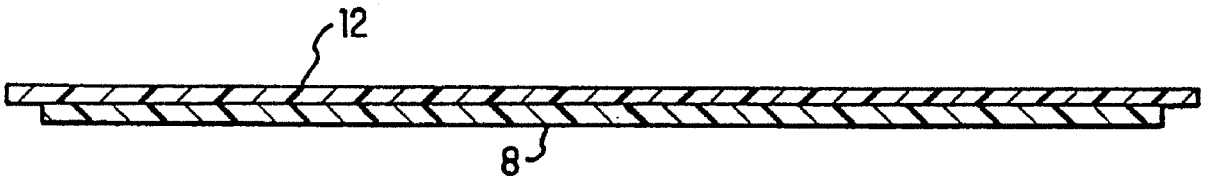
FIG. 5 is a cross-sectional view through the longitudinal center line of FIG. 4.

FIG. 5 is a cross-section view along the longitudinal center line of FIG. 4 showing heat shrinkable patch 8 adhered to the closed end portion of bag 12

Figure 6:
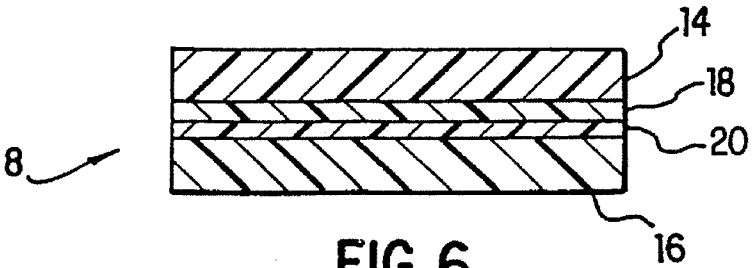
FIG. 6 is an exaggerated sectional view of one embodiment of the patch material of the present invention showing a preferred arrangement of the layers.

FIG. 6 shows a cross-section, in an exaggerated form, of heat shrinkable patch 8 with outer layers 14 and 16 and inner layers 18 and 20. In a preferred embodiment the composition of outer layers 14 and 16 comprises 87% by weight of linear low density polyethylene, 10% by weight of ethylene-vinyl acetate copolymer having 9% vinyl acetate, and 3% pigments and other additives to aid in extrusion. The preferred linear low density polyethylene is Dowlex 2045 from Dow Chemical Company of Midland, Mich. and the preferred ethylene-vinyl acetate copolymer is ELVAX 3128 from the DuPont Company of Wilmington, Del. The inner layers 18 and 20 comprise ethylene-vinyl acetate copolymer ELVAX 3128. All layers have been cross-linked by irradiation to dosage level with is equivalent to 7 MR.

The embodiment as described above is a preferred one but a suitable heat shrinkable patch of the present invention can be made where the inner and outer layers 14 and 16 comprise 15% ethylene-vinyl acetate copolymer having 9% vinyl acetate and 83.3% linear low density polyethylene with the balance of 1.7% being a pigment. In addition, suitable heat shrinkable patches can be make with the outer layers comprising a blend of 90% linear low density polyethylene with 10% vinyl acetate copolymer. Based on experience it is believed that the desirable composition range for the outer layer is 80% to 100% linear low density polyethylene and 20% to 0% ethylene-vinyl acetate copolymer with the vinyl acetate content having a range from 7% to 12% vinyl acetate. The inner layer preferably comprises an ethylene vinyl acetate copolymer having 20% to 35% vinyl acetate content.

It has been surprisingly found that the increased strength and toughness of the heat shrinkable patch according to the present invention is greatly enhanced by the use of linear low density polyethylene. The copolymers referred to as linear low density polyethylene generally have a density of 0.900 to 0.935 grams per cubic centimeter and a crystalline melting point in the range of 110° C. to 125° C. These linear low density polyethylenes are not homopolymers although they are referred to generally as "polyethylene". In fact, they are copolymers of ethylene and an alpha-olefin having a carbon number less than 18, for instance, butene-1, pentene-1, hexene-1, octene-1, etc. In the Dowlex brand of linear low density polyethylene used in the above preferred embodiment it is understood that the alpha-olefin is octene-1. Examples of patents showing the use of such polymers are U.S. Pat. No. 4,425,268 issued on Jan. 8, 1984 to Barry A. Cooper; U.S. Pat. No. 4,456,646 issued on Jun. 26, 1984 to Nishimoto et al.; U.S. Pat. No. 4,399,180 issued on Aug. 16, 1983 to William F. Briggs et al.; and U.S. Pat. No. 4,457,960 issued on Jul. 3, 1984 to David L. Newsome.

Typical vacuum bags are made according to the process shown in U.S. Pat. No. 3,741,253 issued on Jun. 26, 1973 to Harri J. Brax et al. The method of the Brax et al patent Is well understood in the art and provides background for the description which follows for the method of making the heat shrinkable patch of the present invention.

Presently preferred vacuum bags may be made of tubing having four layers comprising, an outer layer (food side) layer (14) of ELVAX 3128 EVA copolymer, a first inner layer (18) of a blend comprising 80% by weight Dowlex 2045 from Dow Chemical, plus 20% by weight of EZ705-009 from Quantum Chemicals, a second inner layer (20) of saran, and a second outer layer (16) of ELVAX 3128 EVA copolymer. Another preferred vacuum bag film formulation may be made from tubing having an outer layer (food side) comprising a blend of 90% by weight of NA 295-000 from Quantum Chemicals and 10% by weight Dowlex 2045 or comprising 85% by weight of Dowlex 2045 and 15% by weight of Quantum EA719-009, a first inner layer (18) of a blend comprising 80% by weight Dowlex 2045 from Dow Chemical, plus 20% by weight of EZ705-009 from Quantum Chemicals, a second inner layer (20) of saran, and a second outer layer (16) comprising 92.5% by weight of an EVA copolymer LD 318.92 from Exxon plus 7.5% by weight of Dowlex 2045.

To make the heat shrinkable patch of one embodiment of the present invention, a first ethylene-vinyl acetate copolymer having a vinyl-acetate content of approximately 28% by weight is sent to a first extruder. This material forms layers 18 and 20 (FIG. 6). Also, a blend having a major proportion of linear low density polyethylene and a minor proportion of a second ethylene-vinyl acetate copolymer, one having a vinyl acetate content in the range of 7% to 12%, is fed into a second extruder. This material forms layers 14 and 16 (FIG. 6). Both extruders feed a common coextrusion die of the type which is well-known in the art. The extrudate which issues from the die has an inner wall of the first ethylene-vinyl acetate copolymer and an outer wall of the blend. This type of coextrusion essentially coextrudes two concentric tubes, one inside the other, and in this case the first vinyl acetate copolymer is the inner tube.

As the tube is extruded downwardly it is closed off and flattened by pinch rollers, but in order to keep the first vinyl acetate copolymer from adhering to itself the interior of the tube is coated with an inert dust or powder, preferably powdered cornstarch, in a surface concentration sufficient to prevent self-adherence. This flattened tubing is then fed through an irradiation vault where it will preferably receive a dosage of approximately 7 MR to cross-link the polymeric materials which comprise the tube. The preferred range is 4.5 MR to 13 MR with the most suitable range being between 6 and 8 MR. Chemical cross-linking using an organic peroxide is thought to be an alternate cross-linking method but quite satisfactory results are obtained through use of irradiation and irradiation cross-linking is preferred. After receiving the cross-linking dosage the tube is opened, inflated, heated, and stretched by the well-known bubble technique which is described in the above mentioned Brax et al. patent. The biaxially stretching orients the tube material. After the material has been stretched to the desired diameter and wall thickness, it is then rapidly cooled and collapsed. This process results in a biaxially oriented heat shrinkable patch material which is heat shrinkable at approximately the temperature at which it was oriented. When collapsed and flattened the tubing will now tend to adhere to itself as the stretching decreases the concentration of the corn starch on the inner surface of the bubble or stretched tubing. This concentration of the corn starch now is low enough to permit self-adherence. The vinyl acetate content of the inner wall is approximately 28% by weight. This is an ethylene-vinyl acetate copolymer in the range where the ethylene-vinyl acetate copolymer acts as an adhesive. Thus, a multi-layer tubular material is produced, in this instance, a four layer material as shown in FIG. 6 is produced. This material can be cut into heat shrinkable patches and adhered to the heat shrinkable tubing which will become the bag used to package the bone-in meat product.

Figure 7:
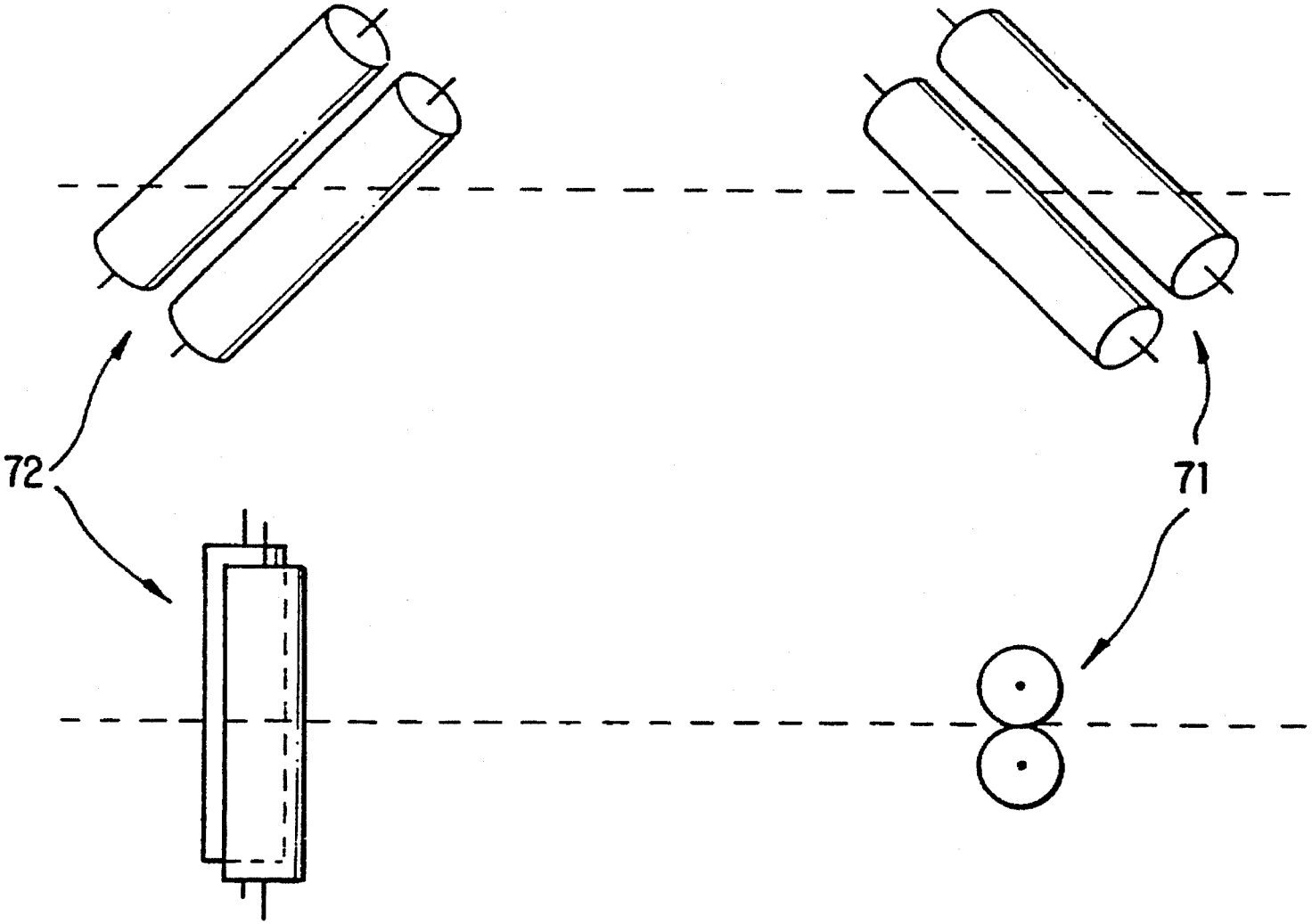
FIG. 7 shows an isometric view and a top view of 2 sets of nib rolls rotated 90 degrees from one another along a common center line.
Figure 8:
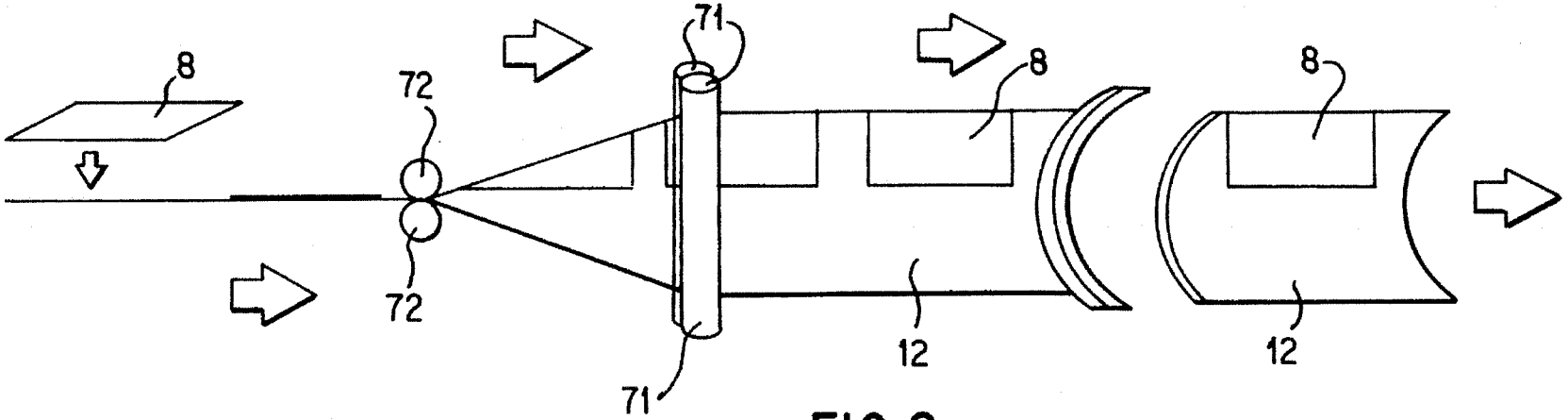
FIG. 8 illustrates a top view of a schematic patch bag process according to the present invention.
Figure 9:
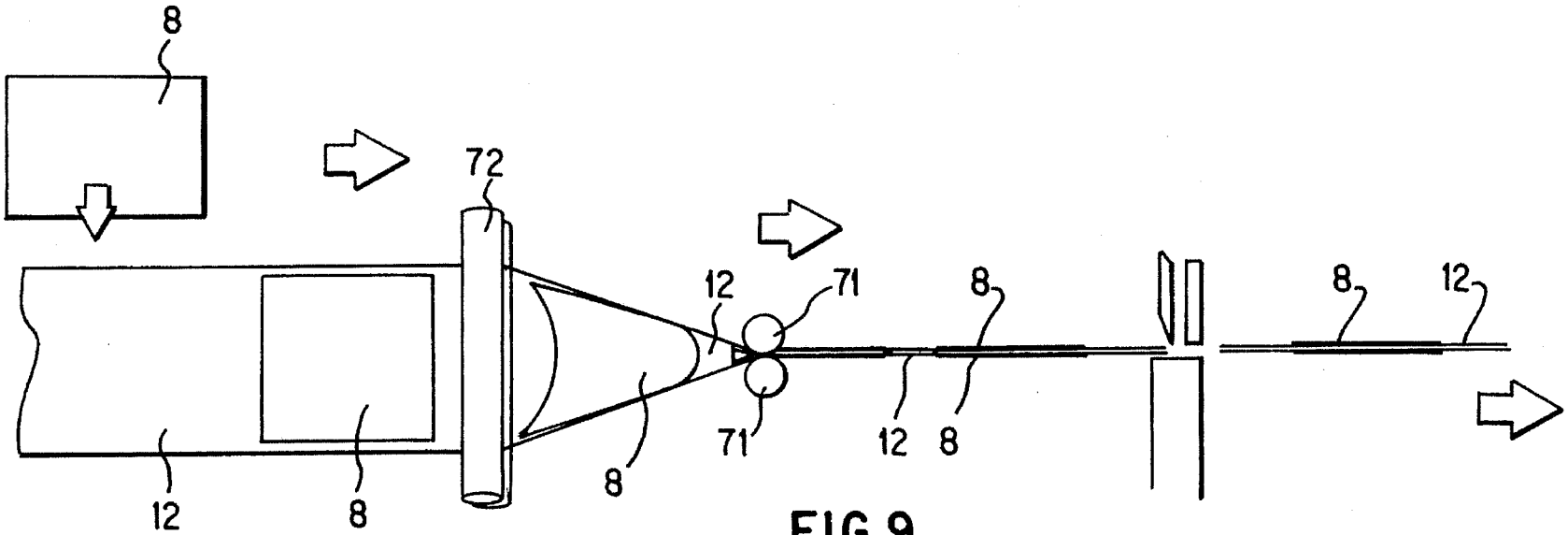
FIG. 9 illustrates a side view of a schematic patch bag process according to the present invention.

FIG. 7 shows a schematic of the two sets of nip rolls 71 & 72. Nip rolls 72 being rotated 90 degrees from nip rolls 71 along their common center line. This is shown both in an isometric view and a top view to clearly illustrate this method of rotating the web to a desired position. It Is to be understood that the degree of rotation of the sets of nip rolls may be any desired amount of rotation to position the patch or patches in a desired location on the finished bag.

The heat shrinkable patches of the present invention may be placed on the vacuum bags in several different positions. The heat shrinkable patch may be placed such that it covers substantially all of the closed end of the bag (FIG. 1). A single patch may be placed such that it covers an area along the side of the bag (FIG. 2). Two or more patches may be placed close to one another to substantially cover the total side area of the bag. Combinations and variations of these placements of the heat shrinkable patches are also within the scope of the present invention.

To achieve specific location of externally adhered heat shrinkable patches of the present invention on the finished bag product which can not be provided in the normal process, a secondary operation Is utilized. The primary patch application process intermittently applies the heat shrinkable patches to collapsed, lay flat, tubing. Subsequent to this, seals are applied across the tubing and the tubing is cut to form an end seal bag. Because the patches are applied to lay flat tubing, limitations are incurred in patch placement on the finished bag product. Specifically, the patches may only approach the edges of the lay flat bag. Patches may be applied to both faces of the lay flat bag to achieve maximum circumferential coverage but since front and back patches may only approach the tubing edge there will remain a discontinuity in patch reinforcement circumferentially around the bag. To alleviate the effect of this discontinuity on protection from bag puncture by bone-in product which may be loaded into the bag, one approach is to move the discontinuity to a position of less significance. This can be achieved in a secondary process to the primary patch application and prior to seal placement and cutting of the tubing into finished bags.

The secondary operation, process, entails inflating tubing to which patches have been intermittently applied to produce a round, cylindrical section. This cylindrical section is trapped between pinch rollers 71 and 72 (FIG. 7) so that the tubing may be pulled through the rollers and an inflated tubing length Is maintained between the pinch rollers 71 and 72. The cylindrical section, bubble, is composed of three distinct zones: diverging, cylindrical, converging. The diverging zone is Immediately past the entrance pinch rollers 71 nips, and is the transition zone from flat to cylindrical as the tubing moves in the machine direction. Similarly, the converging zone is the transition from cylindrical to flat and terminates at the exit pinch rollers 72 nips. The entrance and exit pinch roller nips may be rotated relative to each other when viewed in the machine direction so that the plane of the entering tubing is rotated relative to the plane of the exiting tubing. The edge of the converged tubing, in lay flat state, then Is a different edge from that of the lay flat tubing prior to convergence into the bubble. If the inlet and outlet nips are rotated 90 degrees to each other, the line formed by the contact area of the pinching rolls in each nip being perpendicular to each other as viewed in the machine direction of the tubing, then the original tubing edges will be positioned in the center of the front and back panels of the converged, collapsed, tubing after the secondary process. This then Is a method by which the discontinuity circumferentially of heat shrinkable patch material, on a finished bag may be relocated from the bag edge to some other position, center back and center front in the case of front and back patching in the primary process and 90° rotation in the secondary process.

Numerous variations then become possible in position reinforcing patches on finished bag products through various combinations of primary patch positioning degrees of secondary process rotation and bag conversion, seal forming and cutting, the last of which Is well known in the art. Presently preferred variations which can be accomplished with the process steps described hereinabove include, (a) an end seal bag as described with heat shrinkable patches discontinuity rotated to a position other than the lay flat edge of the bag. This could be composed of front and back patches in the primary process which are then rotated to provide edge protection in the finished bag or it could be composed of front or back patching only in the primary process with rotation in the secondary process accomplishing the positioning of the patch to protect one edge of the finished bag. An end seal bag configuration is produced when tubing is sealed, welded perpendicular to the long axis of the tubing and the tubing is severed or cut adjacent to the seal and this procedure is repeated at some distance further along the tubing that distance being the length of the bag. (b) an end seal bag with no circumferential discontinuity may be produced by applying patches in the primary process, rotating the secondary process applying additional patches in the primary process to cover the discontinuities and overlapping the first applied patches if desired, this then would be followed by conversion into end seal bags, and (c) a side seal bag with heat shrinkable patching extending around the end of the bag may be formed by applying patches in the primary process to one side of the lay flat tubing, rotating in the secondary process and then applying sealing and cutting to form side seal bags in a manner which is well known in the art. A side seal bag is formed when two parallel and adjacent seals, welds, are applied to tubing or to folded sheet perpendicular to the machine direction of the tubing or folded sheet. The tubing or folded sheet is then cut between the seals and the sealing and cutting is repeated at some distance along the tubing or folded sheet that distance then being the width of the bag. In the case of tubing, one edge in the lay flat form would be trimmed off or cut open to form the bag mouth. The edge trimming may be conducted before or after sealing whichever is convenient in the process.

When using side sealed vacuum bags the heat shrinkable patches of the present invention may be placed on the inside surface of these bags as well, or instead of, on the outside surface. Further, on side seal bags a continuous strip of heat shrinkable patch material may be attached down the center of the bag web in the lay flat position and the bag web later folded to position the patch material in a desired position. Further still, on side seal bags the edges of the bags may be sealed through the two layers of bag material or through all 4 layers of bag and patch material. Sealing through all 4 layers allows the use of a continuous strip of heat shrinkable patch material as described above.

Because the heat shrinkable patch shrinks with the vacuum bag the patch may be preprinted before application to the bag allowing better position of the printing. Also, because the patch shrinks with the bag, the patch and/or the bag can be printed after the patch is applied to the bag. In addition, because the patch shrinks with the bag substantially eliminating distortion of the bag in the patch area, the bag may be printed on before or after the patch is applied.

Many suitable adhesives to adhere the heat shrinkable patch to the bag are available and can readily be selected by those skilled in the art, the tendency to delaminate having been greatly reduced as the heat shrinkable patch shrinks biaxially as does the bag. Examples of suitable types of adhesives include thermoplastic acrylic emulsions, solvent based adhesives and high solids adhesives. The presently preferred adhesive is a thermoplastic acrylic emulsion RhoplexN 619 from Rohm & Haas.

Although the illustrative embodiments of the present invention have been described herein with reference to the accompanying drawings it is to be understood that the invention is not limited to those precise embodiments, and that various other changes and modifications may be effected therein by one skilled in the art without departing from the scope or spirit of the invention.

What is claimed is:

1. A process for making a heat shrinkable patch-bag, comprising:

(a) adhering a heat-shrinkable patch to an oriented, heat-shrinkable, thermoplastic tubing in a first lay-flat configuration, the patch being adhered to the tubing with an adhesive;

(b) inflating the tubing so that an inflated tube results, the inflated tube having the patch adhered thereto;

(c) deflating and flattening the tube in a second lay-flat configuration, so that the heat-shrinkable patch is relocated in desired position; and (d) forming a bag from the tube while the tube is in the second lay-flat configuration.

2. The method according to claim 1, wherein the heat-shrinkable patch comprises a heat-shrinkable film comprising four layers.

3. The method according to claim 2, wherein the four layers comprise two outer layers comprising linear low density polyethylene and two inner layers comprising ethylene-vinyl acetate copolymer.

4. The method according to claim 3, wherein:

the two outer layers comprise linear low density polyethylene and ethylene vinyl acetate copolymer comprising vinyl acetate in an amount of from about 7 to 12 weight percent; and the two inner layers comprise ethylene vinyl acetate copolymer comprising vinyl acetate in an amount of from about 20 to 35 weight percent.

5. The method according to claim 4, wherein the two outer layers comprise pigment in an amount up to about 5 weight percent.

6. The process according to claim 1, wherein the heat-shrinkable patch comprises a first biaxially-oriented film, and the heat-shrinkable tubing comprises a second biaxially-oriented film.

7. The method according to claim 6, wherein the process comprises adhering a plurality of heat-shrinkable patches to the tubing.

8. The process according to claim 7, wherein the tubing is formed into an end-seal bag.

9. The process according to claim 8, wherein the patches are on an outside surface of the bag.

10. The process according to claim 9, wherein the oriented, heat shrinkable, thermoplastic tubing comprises a multilayer film.

11. The process according to claim 10, wherein the oriented, heat shrinkable patch comprises a multilayer film.

12. The process according to claim 11, wherein the multilayer film comprises outer layers comprising linear low density polyethylene, and an inner layer comprising ethylene/vinyl acetate copolymer.

13. The process according to claim 12, wherein the heat-shrinkable patch comprises a heat-shrinkable film comprising four layers.

14. The method according to claim 13, wherein the two inner layers each comprise ethylene-vinyl acetate copolymer.

15. The method according to claim 14, wherein:

the two outer layers comprise linear low density polyethylene and ethylene vinyl acetate copolymer comprising vinyl acetate in an amount of from about 7 to 12 weight percent; and the two inner layers comprise ethylene vinyl acetate copolymer comprising vinyl acetate in an amount of from about 20 to 35 weight percent.

16. The process according to claim 6, wherein the tubing is formed into a side-seal bag.

17. The process according to claim 16, wherein the patches are on an outside surface of the bag.

18. The process according to claim 17, wherein the oriented, heat shrinkable, thermoplastic tubing comprises a multilayer film, and the oriented, heat shrinkable patch comprises a multilayer film.

19. The process according to claim 1, wherein the bag comprises only one patch adhered to the tubing.

20. The process according to claim 1, wherein the process comprises adhering a plurality of heat-shrinkable patches to the tubing.

21. The process according to claim 1, wherein the bag is an end-seal bag.

22. The process according to claim 1, wherein the bag is a side-seal bag.

23. The process according to claim 1, wherein the patch is on an outside surface of the bag.

24. The process according to claim 1, wherein the patch is on an inside surface of the bag.

25. The process according to claim 1, wherein the oriented, heat shrinkable, thermoplastic tubing comprises a monolayer film.

26. The process according to claim 1, wherein the oriented, heat shrinkable, thermoplastic tubing comprises a multilayer film.

27. The process according to claim 1, wherein the heat-shrinkable patch comprises a monolayer film.

28. The process according to claim 1, wherein the patch is printed after the patch is adhered to the tubing.

29. The process according to claim 1, wherein the patch is printed before the patch is adhered to the tubing.

30. The process according to claim 1, wherein after the tubing is formed into the bag, the tubing is printed.

31. The process according to claim 1, wherein the tubing is printed before the bag is formed.

32. The process according to claim 1, wherein the heat-shrinkable patch comprises a multilayer film.

33. The process according to claim 32, wherein the multilayer film comprises outer layers comprising linear low density polyethylene, and an inner layer comprising ethylene/vinyl acetate copolymer.

34. The process according to claim 33, wherein at least one layer of the patch has been cross-linked by irradiation at a level of from about 4.5 to 13 megarads.

* * * * *